United States Patent [19]

Arisland

[11] 4,135,513

[45] Jan. 23, 1979

[54] DRINKING NOZZLE FOR BOTTLES AND SIMILAR CONTAINERS

[75] Inventor: Kjell O. Arisland, St. Catharines, Canada

[73] Assignee: A/S Alto, Oslo, Norway

[21] Appl. No.: 725,623

[22] Filed: Sep. 22, 1976

[30] Foreign Application Priority Data

Sep. 26, 1975 [NO] Norway ..... 753274

[51] Int. Cl.[2] ..... A61J 11/04

[52] U.S. Cl. ..... 128/252; 137/494; 215/11 D

[58] Field of Search ..... 128/252; 215/11 D, 11 R, 215/11 B, 11 C, 11 E; 137/DIG. 8, 494

[56] References Cited

U.S. PATENT DOCUMENTS

| | | | |
|---|---|---|---|
| 2,747,573 | 5/1956 | Schaich | 128/252 |
| 2,960,088 | 11/1960 | Witz | 128/252 |
| 2,979,078 | 4/1961 | Witz | 128/252 X |

FOREIGN PATENT DOCUMENTS

| | | | |
|---|---|---|---|
| 2120430 | 11/1971 | Fed. Rep. of Germany | 137/DIG. 8 |

*Primary Examiner*—Robert W. Michell
*Assistant Examiner*—Michael H. Thaler
*Attorney, Agent, or Firm*—Howson and Howson

[57] ABSTRACT

A nozzle to be inserted in the opening of a nursing bottle or similar container and which allows drinking by sucking but prevents leaking when the bottle is left in any position.

4 Claims, 1 Drawing Figure

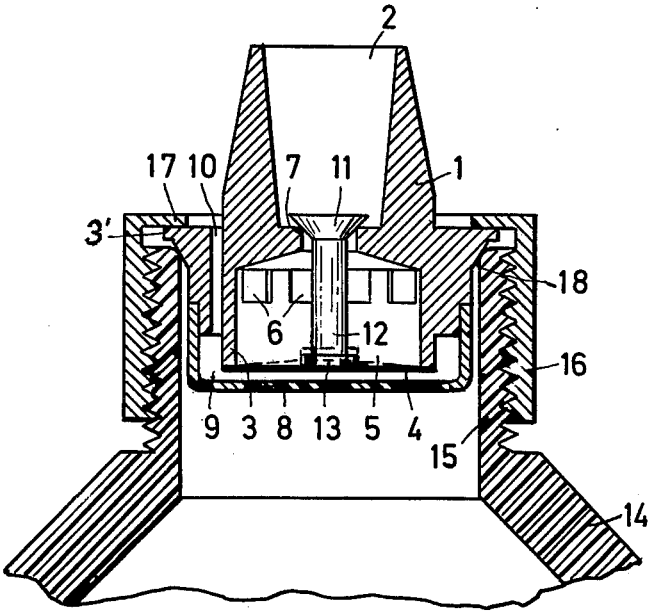
2
17
10
7
11
1
3'
18
6
12
16
9
3
8
13
5
4
15
14

DRINKING NOZZLE FOR BOTTLES AND SIMILAR CONTAINERS

This invention relates to a drinking nozzle for bottles and similar containers, consisting of an inner, hollow, substantially cylindrical member intended for being introduced in a tightening manner into a container opening, and an outer nozzle connected with said member protruding from the container opening.

SUMMARY OF THE INVENTION

The object of the invention is to obtain a drinking nozzle of the above kind which by means of a valve device is kept closed as long as the nozzle is not subjected to an underpressure. A drinking nozzle of said kind may for instance be used in connection with nursing bottles, bottles for use in hospitals and the like.

The characteristic feature of the invention is that between the cylindrical member and the nozzle there is a valve seat, the valve body of which is located at the side of the valve seat turned towards the nozzle and is connected with one end of a shaft introduced through the valve seat, the other end of which is connected with a membrane which along its periphery is fixed to the inner end of the cylindrical member, that the membrane together with a cover arranged outside the inner end of the cylindrical member define a space which through a bore in the cylindrical member is in connection with the atmosphere, that the cylindrical member is provided with openings which connect the inner of the container with the space which is defined by the inner wall of the cylinder, the valve seat, the valve body and the membrane, and that the outer end of the cylindrial member above the said openings is tight-fittingly connected with the free edge of the container opening.

The cylindrical member is preferably provided with an outer flange to be located over the edge of the container opening and for cooperation with an inwardly directed flange on an inwardly threaded sleeve which is screwed on outer threads on the neck which restricts the container opening. However, it is obvious that the drinking nozzle at the upper side of the opening may be formed with an outwardly threaded portion which is screwed in on corresponding inner threads in the container opening, or the outer flange of the drinking nozzle may be arranged to snap into a circumferential recess in the inner wall of the container opening.

According to a further feature of the invention the membrane is fixed to the shaft of the valve body under a pre-stress so that the membrane keeps the valve body against the valve seat with a certain pressure.

BRIEF DESCRIPTION OF THE DRAWINGS

These and other features of the invention will appear from the following description of a drinking nozzle for bottles shown in the drawing in axial section.

DETAILED DESCRIPTION OF SPECIFIC EMBODIMENTS

The drawing shows a valve housing 1 which by means of a threaded sleeve 16 with inwardly directed flange 17 is tight-fittingly arranged in the neck 15 of a bottle 14 or another closed container, the valve housing being formed with an outwardly directed flange 3' which via a conic portion 18 continues into a cylindrical portion 3 of the valve housing 1. The upper part of the valve housing is provided with a drinking nozzle 2 which protrudes from the opening of the bottle.

The inside of the valve housing between the cylindrical portion 3 and the drinking nozzle 2 is formed with a valve seat 7, and the valve body 11 belonging thereto is provided with a valve shaft 12 which is introduced through the valve seat 7 and at its lower enlarged end is provided with the central portion of a membrane 4 which along its edge is tight-fittingly fixed to the lower end of the cylindrical portion 3, so that there is formed an inner space which is defined by the valve seat 7, the cylindrical portion 3 and the membrane 4. This space 5 is, through radially extending openings 6 in the side wall of the cylindrical portion, connected with the space which is defined by the neck 15 of the bottle 14 and the cylindrical portion 3. Upon the lower end of the cylindrical portion there is placed a cover 8 which defines, together with the membrane 4, a space 9 which through an axis-parallel channel 10 is in connection with the atmosphere.

The underpressure which arises in the container as a consequence of the user sucking out liquid, will be balanced by the valve letting in air after the user removed the drinking nozzle from mouth. A semi-rigid bottle, therefore, will be flattened when the liquid is sucked out, but will regain its original shape when the user terminates sucking. However, a plastic bag will remain flattened; the advantage is here that the valve does not leak as does a bottle-sucker when mounted on a plastic bag.

The valve body 11 is preferably held pressed against the valve seat 7 with a certain pre-stress, the valve shaft 12 being made a bit shorter than shown in full lines, so that the membrane will bulge somewhat into the space 5, as shown in dotted lines.

The tightening obtained between the valve body and the valve seat by means of the said pre-stress of the membrane is sufficient for preventing the liquid from flowing out from the bottle through the valve when the bottle is placed on the side.

When the container is turned upside down and is shaken or pressed together, there are, however, greater forces which act, and the tightening force caused by the pre-stress of the membrane is, in that case, relatively insignificant. The pressure arising in the space 5 when the container is put under pressure, will act with a force on the membrane 4 in the direction away from the valve seat 7, so that the valve body 11 is pressed against the valve seat with a force which increases proportionally with the pressure in the space 5, Consequently, the container 14 with the drinking nozzle arranged thereon, may be brought to attain any position or be subjected to any physical treatment within the limits set by the materials of which the bottle with drinking nozzle is made, without any liquid flowing out unintentionally.

When by suction on the nozzle there is created an underpressure in the space defined by the nozzle 2, the valve seat 7 and the valve body 11, the valve body will first be lifted from the seat so that the liquid contained in the space 5 will flow out through the valve seat 7. When gradually still more liquid is sucked out of the container 14 through the drinking nozzle, there will be built up an underpressure in the container and in the space 5. The underpressure in the space 5 will, together with the atmosphere pressure in the space 9, cause the central portion of the membrane to bulge out in the space 5 even if the underpressure in the nozzle 2 disappears the sucking discontinues. Thereby air will be sucked into the container through the nozzle until the underpressure in the container 14 has become so small that the pre-stress of the membrane is sufficient to close the valve.

We claim:

1. Drinking nozzle apparatus for bottles or similar containers, comprising:

an inner, hollow, substantially cylindrical member adapted to be introduced in a tightenable manner into a container opening;

an outer nozzle connected with said cylindrical member and adapted to protrude from said container opening;

a valve located in the communicating path between said cylindrical member and said nozzle;

said valve comprising a valve seat, a valve body and a shaft extending through said valve seat and connected at one end to said valve body, said valve body being positioned on the side of said valve seat facing said nozzle;

a membrane connected to the other end of said shaft, said membrane being connected along its periphery to the inner end of said cylindrical member;

a cover secured to said cylindrical member and projecting below the inner end of said cylindrical member to define a space between said membrane and said cover;

a bore extending axially through said cylindrical member and providing communication between said space and the atmosphere;

said cylindrical member also containing openings positioned to connect the inside of said container with the space within the hollow interior of said cylindrical member;

said cylindrical member having a peripheral seal portion extending radially outward of said openings and adapted to be in sealed engagement with the free edge of said container opening;

said nozzle extending axially outward on one side of said seal portion, and said bore communicating with atmosphere on said one side of said seal portion.

2. Drinking nozzle apparatus according to claim 1, in which said seal portion comprises a radially outwardly extending flange adapted to be located over said free edge of said container, said apparatus comprising an interiorly-threaded sleeve having an inwardly-directed flange and adapted to be screwed onto the exterior of the neck of said container adjacent said free edge to urge said inwardly-directed flange toward said outwardly extending flange.

3. Drinking nozzle apparatus according to claim 2, wherein said cylindrical member comprises a conical portion positioned below said radially outwardly extending flange and adapted to form a seal against the inner side of said container opening when said sleeve is tightened onto said neck.

4. Drinking nozzle apparatus according to claim 1, comprising means for pre-stressing said membrane in the direction to hold said valve body in engagement with said valve seat with a predetermined pressure.

* * * * *